US006107586A

United States Patent [19]

Takeuchi et al.

[11] Patent Number: 6,107,586

[45] Date of Patent: Aug. 22, 2000

[54] PUSH-ON SWITCH

[75] Inventors: Masatsugu Takeuchi; Hisashi Watanabe, both of Okayama-ken; Hiroshi Matsui, Osaka, all of Japan

[73] Assignee: Matsushita Electric Industrial Co., Ltd., Osaka, Japan

[21] Appl. No.: 09/181,866

[22] Filed: Oct. 29, 1998

[30] Foreign Application Priority Data

Nov. 13, 1997 [JP] Japan ..... 9-311759

[51] Int. Cl.[7] ..... H01H 1/26

[52] U.S. Cl. ..... 200/535; 200/520

[58] Field of Search ..... 200/512, 517, 200/520, 534, 559, 561, 245, 341, 239

[56] References Cited

U.S. PATENT DOCUMENTS

| | | | |
|---|---|---|---|
| 3,809,838 | 5/1974 | Coppola | 200/159 |
| 4,438,304 | 3/1984 | Kennedy | 200/67 D |
| 4,499,342 | 2/1985 | Nakayama | 200/5 E |
| 4,952,762 | 8/1990 | Koyanagi | 200/517 |
| 5,158,172 | 10/1992 | Roeser et al. | 200/553 |
| 5,345,051 | 9/1994 | Miike | 200/345 |

*Primary Examiner*—Michael L. Gellner
*Assistant Examiner*—Nhung Nguyen
*Attorney, Agent, or Firm*—Louis Woo

[57] ABSTRACT

A push-on switch includes a casing made of insulating material and having an inner bottom surface. First fixed contacts are provided on the inner bottom surface of the casing. Second fixed contacts are provided on the inner bottom surface of the casing. Movable contacts have base portions and resilient contact arms. The base portions are placed on and electrically connected to the first fixed contacts respectively. The resilient contact arms extend from the base portions to regions above the second fixed contacts respectively. A dome-shaped spring member made of resilient insulating material has a top portion, a conical portion, and a lower end. The top portion and the lower end are connected by the conical portion. The lower end is placed on the base portions of the movable contacts. The top portion has a lower surface located above free ends of the resilient contact arms of the movable contacts. A lid member fixed to the casing has a hole through which the top portion of the dome-shaped spring member extends. The lid member presses the lower end of the dome-shaped spring member against the base portions of the movable contacts. As the top portion of the dome-shaped spring member is depressed, the dome-shaped spring member brings the resilient contact arms into contact with the second fixed contacts respectively.

10 Claims, 17 Drawing Sheets

PUSH-ON SWITCH

BACKGROUND OF THE INVENTION

1. Field of the Invention

This invention relates to a push-on switch having a plurality of independent circuit switching portions.

2. Description of the Related Art

In general, electronic apparatuses such as telephone sets and facsimile machines have input button switches including push-on switches. In prior-art push-on switches, the shapes of contact portions are relatively complicated. Furthermore, each of the contact portions has a large number of parts. Thus, general methods of manufacturing the prior-art push-on switches have many steps. Accordingly, the prior-art push-on switches tend to be high in cost.

SUMMARY OF THE INVENTION

It is an object of this invention to provide an improved push-on switch.

A first aspect of this invention provides a push-on switch comprising a casing made of insulating material and having an inner bottom surface; first fixed contacts provided on the inner bottom surface of the casing; second fixed contacts provided on the inner bottom surface of the casing; movable contacts having base portions and resilient contact arms, the base portions being placed on and electrically connected to the first fixed contacts respectively, the resilient contact arms extending from the base portions to regions above the second fixed contacts respectively; a dome-shaped spring member made of resilient insulating material and having a top portion, a conical portion, and a lower end, the top portion and the lower end being connected by the conical portion, the lower end being placed on the base portions of the movable contacts, the top portion having a lower surface located above free ends of the resilient contact arms of the movable contacts; and a lid member fixed to the casing and having a hole through which the top portion of the dome-shaped spring member extends, the lid member pressing the lower end of the dome-shaped spring member against the base portions of the movable contacts; wherein as the top portion of the dome-shaped spring member is depressed, the dome-shaped spring member brings the resilient contact arms into contact with the second fixed contacts respectively.

A second aspect of this invention is based on the first aspect thereof, and provides a push-on switch wherein the casing has a projection at the inner bottom surface thereof, the projection extending along a circle, the base portions of the movable contacts being located between the projection and an outer side wall of the casing, the projection having grooves through which the resilient contact arms of the movable contacts extend, the lower end of the dome-shaped spring member being located between the projection and the outer side wall of the casing.

A third aspect of this invention is based on the first aspect thereof, and provides a push-on switch wherein the base portions of the movable contacts are connected by insulating members while lower surfaces of the base portions of the movable contacts are uncovered from the insulating members.

A fourth aspect of this invention provides a push-on switch comprising a casing made of insulating material and having an inner bottom surface; first fixed contacts provided on the inner bottom surface of the casing; second fixed contacts provided on the inner bottom surface of the casing; movable contacts having base portions and resilient contact arms, the base portions being placed on and electrically connected to the first fixed contacts respectively, the resilient contact arms extending from the base portions to regions above the second fixed contacts respectively; a dome-shaped spring member made of resilient insulating material and having a top portion, a conical portion, and a lower end, the top portion and the lower end being connected by the conical portion, the lower end being placed on the base portions of the movable contacts, the top portion having a lower surface located above free ends of the resilient contact arms of the movable contacts; a push button made of rigid material and placed on the top portion of the dome-shaped spring member; and a lid member fixed to the casing and having a hole through which the push button extends, the lid member pressing the lower end of the dome-shaped spring member against the base portions of the movable contacts, the lid member supporting the push button; wherein as the push button is depressed, the dome-shaped spring member is moved by the push button and brings the resilient contact arms into contact with the second fixed contacts respectively.

A fifth aspect of this invention is based on the fourth aspect thereof, and provides a push-on switch wherein the push button has a recess, and the top portion of the dome-shaped spring member has a projection fitting into the recess of the push button to provide an engagement between the push button and the top portion of the dome-shaped spring member.

A sixth aspect of this invention is based on the fourth aspect thereof, and provides a push-on switch further comprising a key coupling provided between the push button and the lid member for allowing depression of the push button relative to the lid member while inhibiting the push button from circumferentially rotating relative to the lid member.

A seventh aspect of this invention is based on the fifth aspect thereof, and provides a push-on switch further comprising a key coupling provided between the push button and the lid member for allowing depression of the push button relative to the lid member while inhibiting the push button from circumferentially rotating relative to the lid member.

An eighth aspect of this invention is based on the fourth aspect thereof, and provides a push-on switch wherein the casing has a stem extending upward from the inner bottom surface thereof, and the top portion of the dome-shaped spring member has a hole through which the stem extends, and the push button has a recess into which the stem extends.

A ninth aspect of this invention is based on the fourth aspect thereof, and provides a push-on switch wherein the base portions of the movable contacts are connected by insulating members while lower surfaces of the base portions of the movable contacts are uncovered from the insulating members.

A tenth aspect of this invention is based on the fourth aspect thereof, and provides a push-on switch wherein the casing has a projection at the inner bottom surface thereof, the projection extending along a circle, the base portions of the movable contacts being located between the projection and an outer side wall of the casing, the projection having grooves through which the resilient contact arms of the movable contacts extend, the lower end of the dome-shaped spring member being located between the projection and the outer side wall of the casing.

DESCRIPTION OF THE PREFERRED EMBODIMENTS

A prior-art push-on switch will be explained below for a better understanding of this invention.

Figure 1:
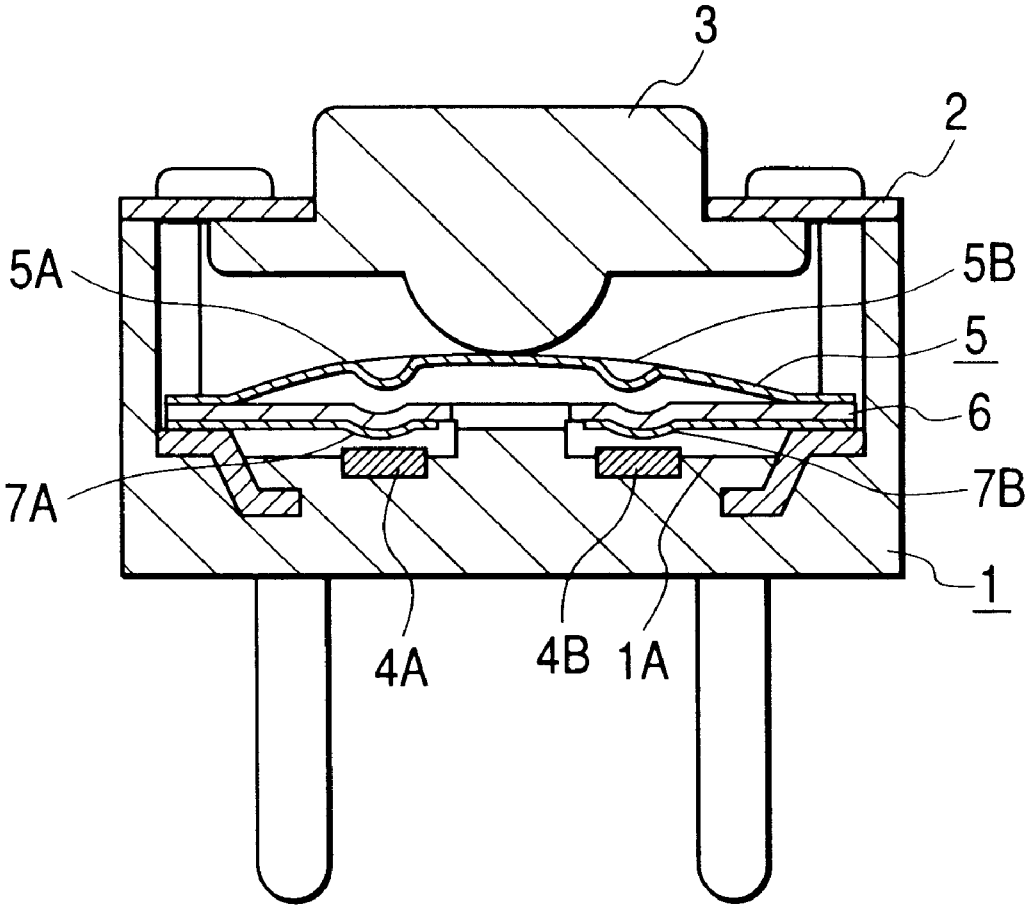
FIG. 1 PRIOR ART
FIG. 1 is a sectional view of a prior-art push-on switch.
Figure 2:
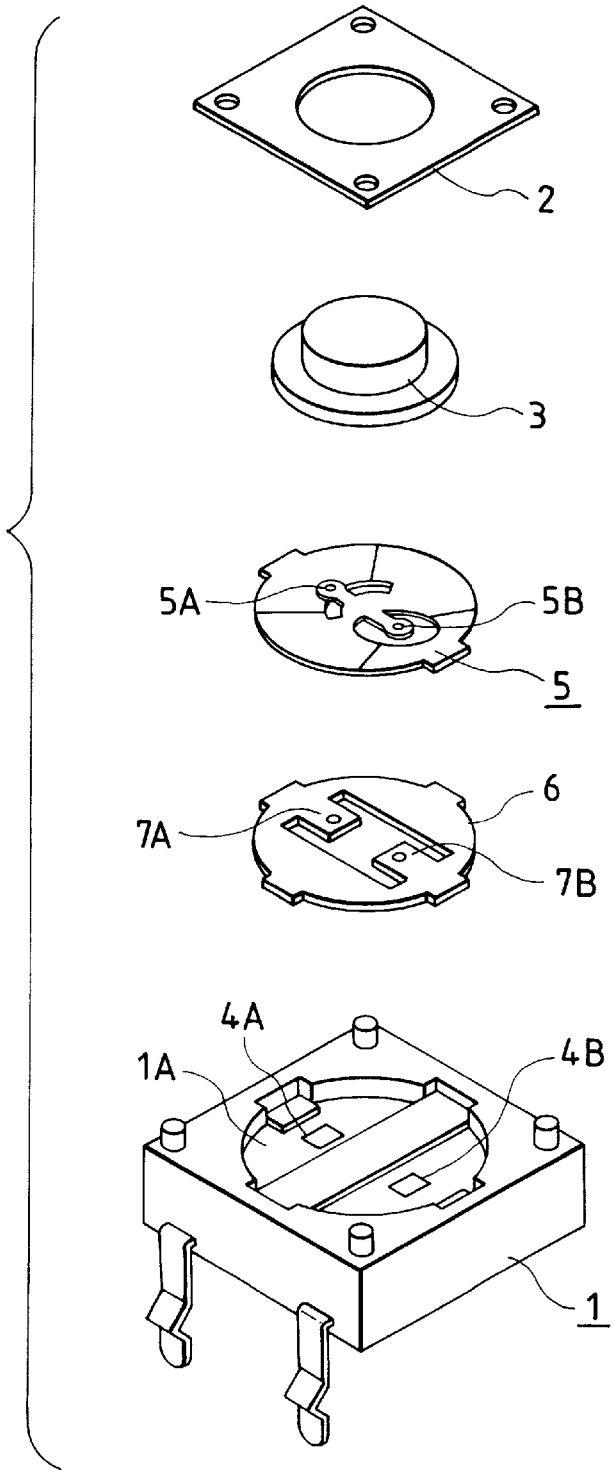
FIG. 2 PRIOR ART
FIG. 2 is an exploded perspective view of the prior-art push-on switch in FIG. 1.

FIGS. 1 and 2 shows a prior-art push-on switch having two independent circuit switching portions. As shown in FIGS. 1 and 2, the prior-art push-on switch includes a casing 1 having an upwardly-facing recess forming an interior thereof. The casing 1 is made of insulating resin. A lid plate 2 is fixed to an upper end of the casing 1. A button 3 is movably supported on an upper portion of the casing 1 by the lid plate 2. The button 3 has a body extending through a central opening in the lid plate 2. The button 3 has a flange which can engage the lower surfaces of the lid plate 2.

In the prior-art push-on switch of FIGS. 1 and 2, first and second fixed contacts 4A and 4B are provided on the bottom surfaces 1A of the recess in the casing 1. The casing 1 accommodates a dome-shaped leaf spring 5 and a flexible insulating plate 6. The leaf spring 5 extends below and contacts with the button 3. The insulating plate 6 extends between the leaf spring 5 and the bottom surfaces 1A of the recess in the casing 1. First and second movable contacts 7A and 7B are bonded to the lower surfaces of the insulating plate 6. The first and second movable contacts 7A and 7B are opposed to the first and second fixed contacts 4A and 4B, respectively. The leaf spring 5 has first and second downward projections 5A and 5B located directly above portions of the insulating plate 6 to which the first and second movable contacts 7A and 7B are bonded, respectively.

The prior-art push-on switch of FIGS. 1 and 2 can be changed between a normal position and an active position. The normal position corresponds to an OFF position while the active position corresponds to an ON position.

When the prior-art push-on switch is in its normal position (its OFF position), the leaf spring 5 presses the button 3 upward against the lid plate 2. Accordingly, in this case, the button 3 is in its uppermost position. When the prior-art push-on switch is in its normal position (its OFF position), the first and second downward projections 5A and 5B on the leaf spring 5 are separate from the insulating plate 6. In addition, the first and second movable contacts 7A and 7B on the insulating plate 6 are separate from the first and second fixed contacts 4A and 4B.

As the button 3 is depressed from its uppermost position to move the prior-art push-on switch out of its OFF position, the button 3 presses and deforms the leaf spring 5 toward the bottom surfaces 1A of the recess in the casing 1. Therefore, the first and second downward projections 5A and 5B on the leaf spring 5 move toward the insulating plate 6. Then, the first and second downward projections 5A and 5B meet the insulating plate 6, and then deform the insulating plate 6 toward the bottom surfaces 1A of the recess in the casing 1. Thus, the first and second movable contacts 7A and 7B on the insulating plate 6 move toward the fixed contacts 4A and 4B, respectively. Finally, the first and second movable contacts 7A and 7B simultaneously meet the fixed contacts 4A and 4B, respectively. When the first and second movable contacts 7A and 7B meet the fixed contacts 4A and 4B, the prior-art push-on switch falls into its ON state.

In the prior-art push-on switch of FIGS. 1 and 2, a contact portion has many parts including the first and second fixed contacts 4A and 4B, the first and second movable contacts 7A and 7B, and the insulating plate 6. The contact portion has a complicated shape. As previously indicated, the first and second movable contacts 7A and 7B are bonded to the lower surfaces of the insulating plate 6. Accordingly, a general method of manufacturing the prior-art push-on switch has many steps. Thus, the prior-art push-on switch tends to be high in cost.

First Embodiment

Figure 3:
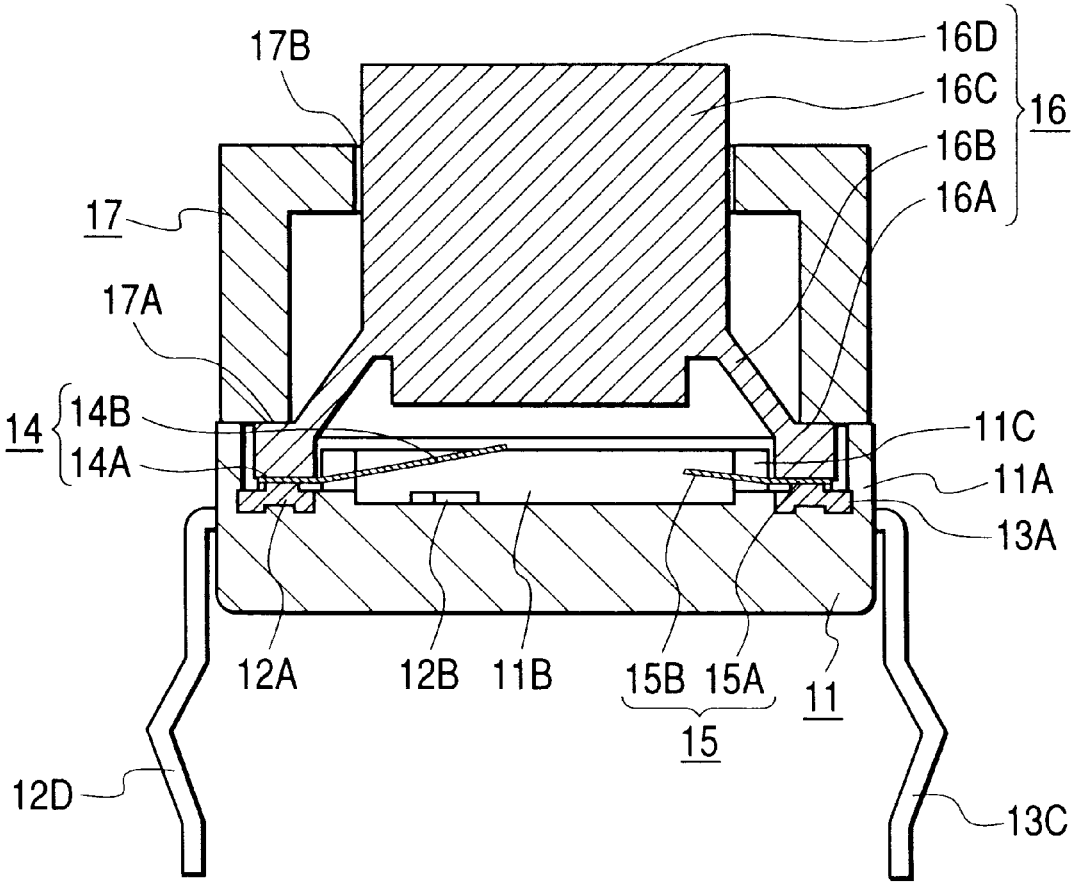
FIG. 3 is a sectional view of a 2-circuit push-on switch according to a first embodiment of this invention.
Figure 4:
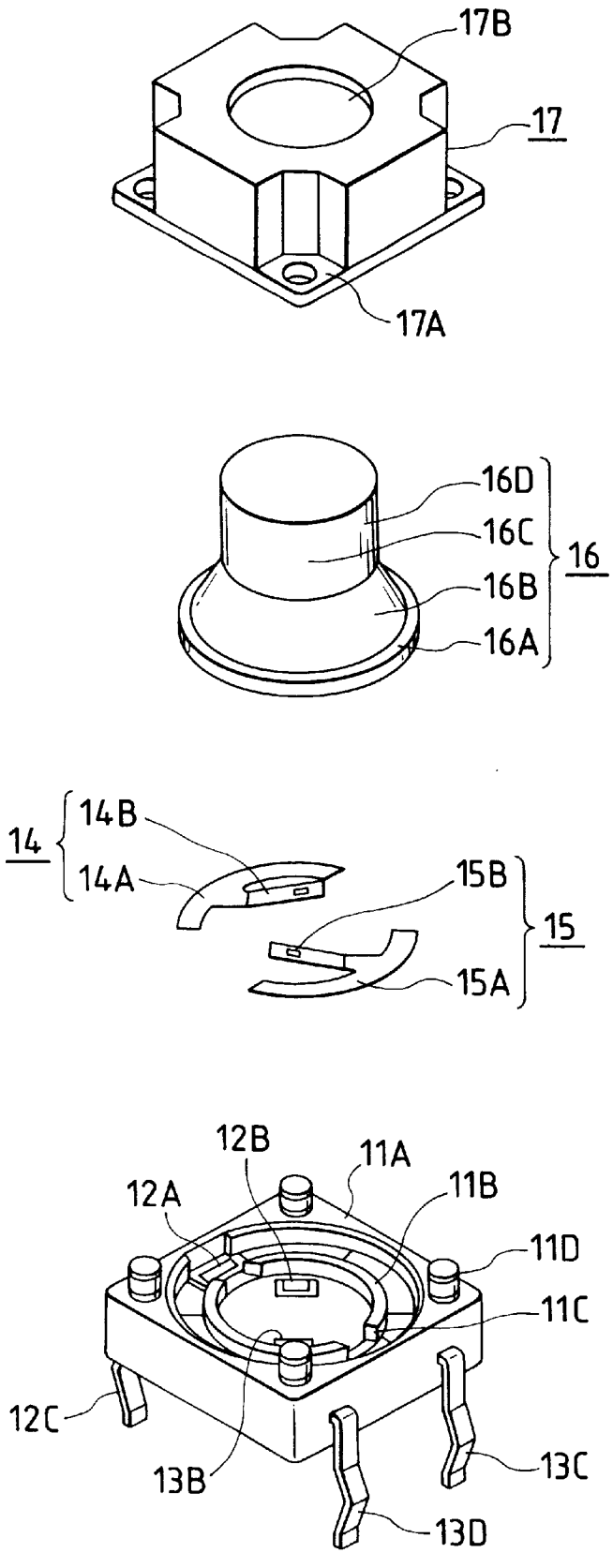
FIG. 4 is an exploded perspective view of the 2-circuit push-on switch in FIG. 3.

FIGS. 3 and 4 show a 2-circuit push-on switch according to a first embodiment of this invention. The push-on switch of FIGS. 3 and 4 includes a casing 11 having an upwardly-facing recess of a circular or cylindrical shape. The casing 11 is made of insulating resin. The casing 11 has outer side walls 11A extending around the recess therein. The casing 11 has an upward projection 11B extending on the bottom surfaces of the recess therein. The upward projection 11B extends along a circle. Thus, the upward projection 11B has an approximately annular shape. The annular projection 11B has a relatively small width. The annular projection 11B extends concentrically inward of the outer side walls 11A of the casing 11. The annular projection 11B is spaced radially from the inner circumferential surfaces of the outer side walls 11A by a distance which is approximately constant throughout the circle. The annular projections 11B has first and second grooves 11C diametrically opposed to each other. As will be explained later, the first and second grooves 11C are used to accommodate portions of movable contacts.

A pair of an outer fixed contact 12A and an inner fixed contact 12B are provided on the bottom surfaces of the recess in the casing 11 by an insert molding process. Similarly, a pair of an outer fixed contact 13A and an inner fixed contact 13B are provided on the bottom surfaces of the recess in the casing 11 by the insert molding process. The outer fixed contacts 12A and 13A are located outward of the annular projection 11B. The inner fixed contacts 12B and 13B are located inward of the annular projection 11B. A connection terminal 12C is electrically connected to the outer fixed contact 12A. A connection terminal 12D is electrically connected to the inner fixed contact 12B. A connection terminal 13C is electrically connected to the outer fixed contact 13A. A connection terminal 13D is electrically connected to the inner fixed contact 13B. The connection terminals 12C, 12D, 13C, and 13D extend out of the sides of the walls of the casing 11, and then bend and extend downward. The connection terminals 12C, 12D, 13C, and 13D form four legs extending outward from the casing 11 and having given shapes.

Figure 5:
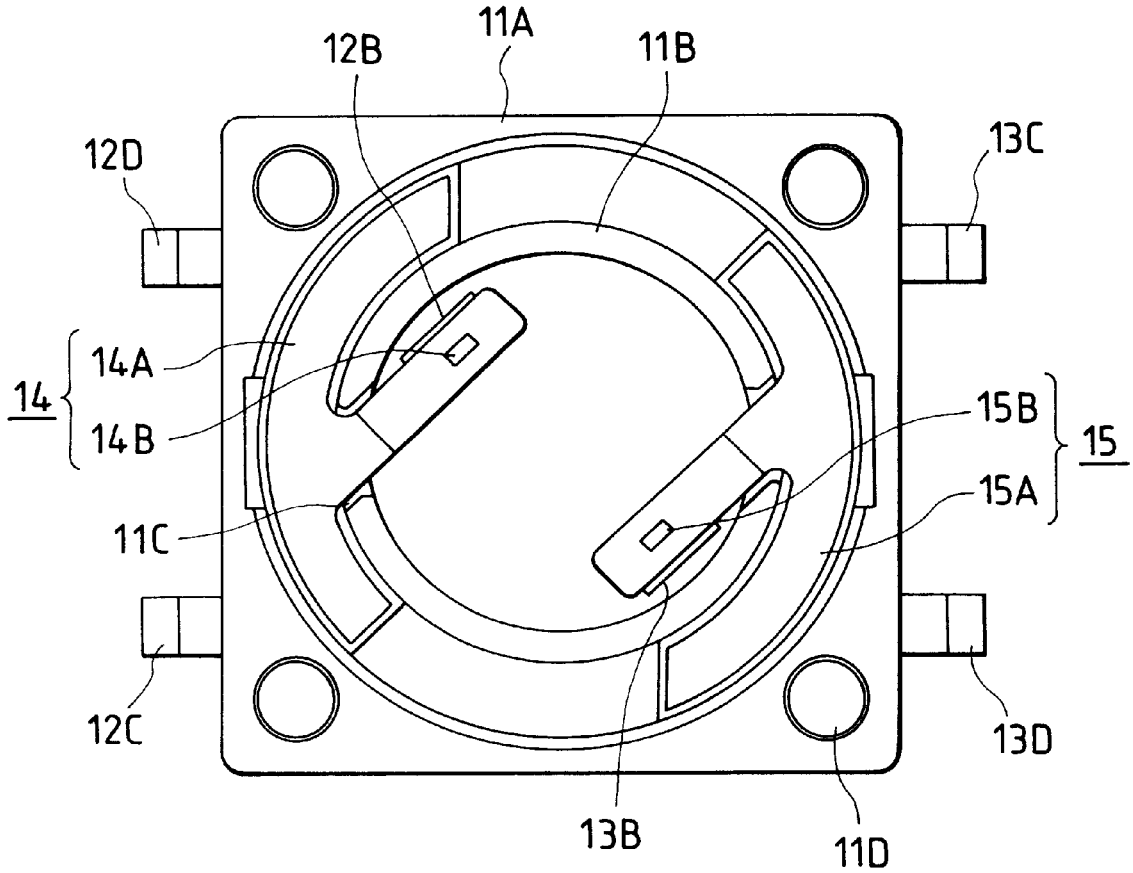
FIG. 5 is a top view of a casing and related parts in the 2-circuit push-on switch in FIG. 3.

As shown in FIGS. 3, 4, and 5, a movable contact 14 made of a thin resilient metal plate has a base portion 14A and a resilient contact arm 14B. The base portion 14A has a shape corresponding to a part of a circumference. The resilient contact arm 14B extends from the base portion 14A along an upwardly-sloping and inward direction. The base portion 14A is located and supported between the annular projection 11B and the outer side walls 11A of the casing 11. The base portion 14A extends on and electrically connects with the outer fixed contact 12A. The resilient contact arm 14B extends through the first groove 11C in the annular projection 11B. A free end portion of the resilient contact arm 14B extends above the inner fixed contact 12B. Normally, the resilient contact arm 14B is separate from the inner fixed contact 12B.

Similarly, a movable contact 15 made of a thin resilient metal plate has a base portion 15A and a resilient contact arm 15B. The base portion 15A has a shape corresponding to a part of a circumference. The resilient contact arm 15B extends from the base portion 15A along an upwardly-sloping and inward direction. The base portion 15A is located and supported between the annular projection 11B and the outer side walls 11A of the casing 11. The base portion 15A extends on and electrically connects with the outer fixed contact 13A. The resilient contact arm 15B extends through the second groove 11C in the annular projection 11B. A free end portion of the resilient contact arm 15B extends above the inner fixed contact 13B. Normally, the resilient contact arm 15B is separate from the inner fixed contact 13B.

A dome-shaped spring member 16 made of resilient insulating material has a cylindrical lower end (an annular lower end) 16A which is located and supported between the annular projection 11B and the outer side walls 11A of the casing 11. The cylindrical lower end 16A of the dome-shaped spring member 16 extends on the base portions 14A and 15A of the movable contacts 14 and 15. The dome-shaped spring member 16 has a dome portion 16B and a central top portion (a main portion) 16C. The dome portion 16B connects the cylindrical lower end 16A and the central top portion 16C. The dome portion 16B has thin walls. The dome portion 16B has a shape corresponding to a part of a cone. The central top portion 16C has a cylindrical shape. Preferably, the central top portion 16C is solid. The central top portion 16C is located above the resilient contact arms 14B and 15B of the movable contacts 14 and 15. Normally, the lower end surface of the central top portion 16C is spaced from the resilient contact arms 14B and 15B by a predetermined distance. An upper part 16D of the central top portion 16C forms an operating projection to be depressed.

A lid member 17 is fixed to and located above the casing 11. The lid member 17 and the casing 11 define a switch interior space, a part of which is formed by the recess in the casing 11. Thus, the lid member 17 closes an upper end of the recess in the casing 11. The casing 11 has four corners formed with upwardly-projecting dowels 11D respectively. The lid member 17 has four corners formed with apertures through which the dowels 11D of the casing 11 extend respectively. During assembly of the 2-circuit push-on switch, the dowels 11 of the casing 11 are deformed by a pressing process to fix the lid member 17 to the casing 11. Edge areas of the lower surfaces 17A of the lid member 17 abut against upper surfaces of the outer side walls 11A of the casing 11 and also upper surfaces of the cylindrical lower end 16A of the dome-shaped spring member 16. Accordingly, the cylindrical lower end 16A of the dome-shaped spring member 16 presses the base portions 14A and 15A of the movable contacts 14 and 15 against the outer fixed contacts 12A and 13A respectively. Thus, the base portions 14A and 15A of the movable contacts 14 and 15 are reliably in electrical connection with the outer fixed contacts 12A and 13A respectively.

An upper portion of the lid member 17 has a central circular hole 17B through which the central top portion 16C of the dome-shaped spring member 16 movably extends. Normally, the upper part 16D of the central top portion 16C, which forms the operating projection, extends outward of the central circular hole 17B in the lid member 17.

Figure 6:
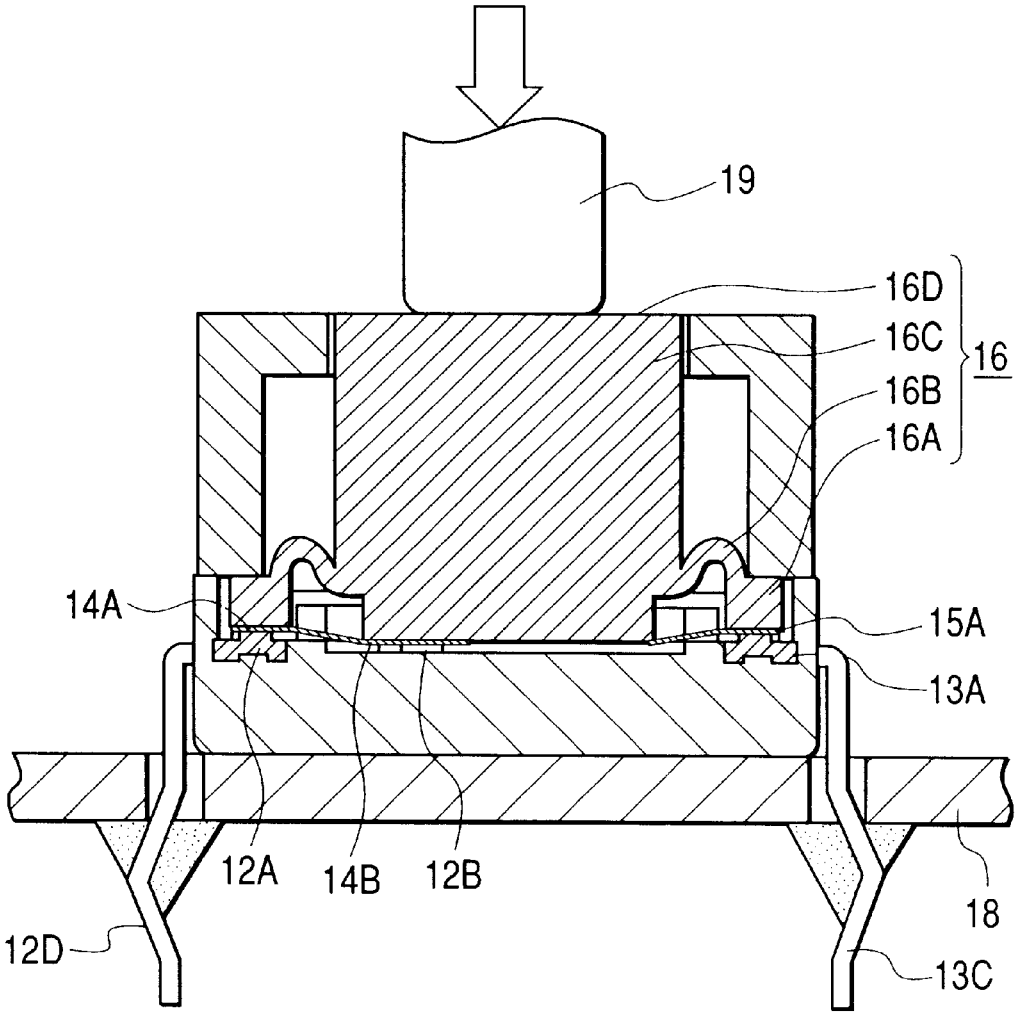
FIG. 6 is a sectional view of a portion of an electronic apparatus including the 2-circuit push-on switch in FIG. 3.

An explanation will be given of operation of the 2-circuit push-on switch of this embodiment. As shown in FIG. 6, the 2-circuit push-on switch is mounted on, for example, a printed circuit board 18 in an electronic apparatus. With reference to FIG. 3, when the 2-circuit push-on switch is in a normal state (an OFF state), the central top portion 16C of the dome-shaped spring member 16 is in its uppermost position. In this case, the lower end surface of the central top portion 16C is separate from the resilient contact arms 14B and 15B, and also the resilient contact arms 14B and 15B are separate from the inner fixed contacts 12B and 13B respectively.

As the central top portion 16C of the dome-shaped spring member 16 is depressed, the 2-circuit push-on switch changes from its normal state (its OFF state) to its ON state. Specifically, with reference to FIG. 6, as the central top portion 16C of the dome-shaped spring member 16 is depressed via an operation button 19 in the electronic apparatus, the dome portion 16B of the dome-shaped spring member 16 is resiliently deformed. The deformation of the dome portion 16B generates a reactional force which gives a suitable operation feeling to the user. During the depression of the central top portion 16C of the dome-shaped spring member 16, the lower end surface of the central top portion 16C meets the resilient contact arms 14B and 15B. Then, the central top portion 16C of the dome-shaped spring member 16 forces the resilient contact arms 14B and 15B downward, and brings them into contact with the inner fixed contacts 12B and 13B respectively. In this way, the 2-circuit push-on switch changes to its ON state where the resilient contact arms 14B and 15B are in electrical connection with the inner fixed contacts 12B and 13B respectively. In this case, the connection terminals 12C and 13C are in electrical connection with the connection terminals 12D and 13D respectively. When the 2-circuit push-on switch assumes its ON state, the connection terminals 12C and 13C are electrically connected to the connection terminals 12D and 13D respectively at substantially the same time.

When the application of the depressing force to the central top portion 16C of the dome-shaped spring member 16 is removed, the dome portion 16B of the dome-shaped spring member 16 returns to its original shape. As the dome portion 16B of the dome-shaped spring member 16 returns to its original shape, the central top portion 16C of the dome-shaped spring member 16 is moved upward. During the upward movement of the central top portion 16C of the dome-shaped spring member 16, the resilient contact arms 14B and 15B separate from the inner fixed contacts 12B and 13B respectively. Thus, the resilient contact arms 14B and 15B move out of electrical connection with the inner fixed contacts 12B and 13B respectively, and the connection terminals 12C and 13C are electrically disconnected from the connection terminals 12D and 13D respectively. Subsequently, the central top portion 16C of the dome-shaped spring member 16 separates from the resilient contact arms 14B and 15B, and then returns to its uppermost position. When the central top portion 16C of the dome-shaped spring member 16 reaches its uppermost position, the 2-circuit push-on switch returns to its normal state (its OFF state).

The 2-circuit push-on switch of this embodiment has a relatively simple structure. The 2-circuit push-on switch has a relatively small number of parts. Accordingly, the 2-circuit push-on switch is low in cost. In addition, the 2-circuit push-on switch can be stably operated.

It should be noted that the 2-circuit push-on switch of this embodiment may be modified into a 3-circuit or more-circuit push-on switch.

Second Embodiment

Figure 7:
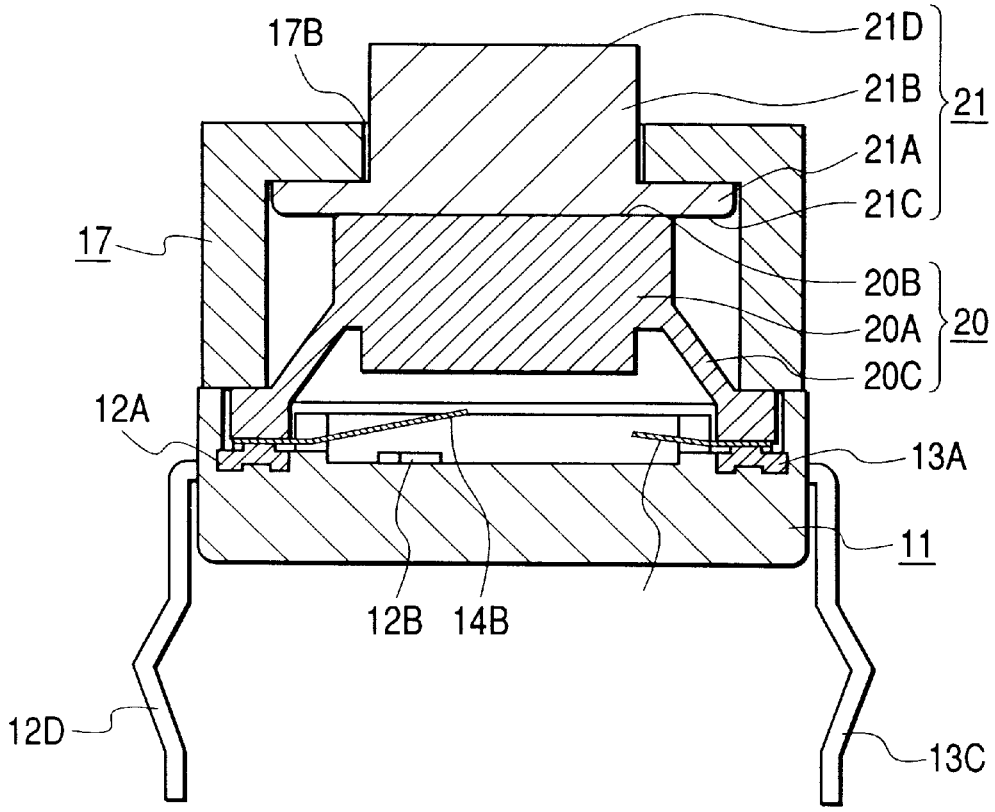
FIG. 7 is a sectional view of a 2-circuit push-on switch according to a second embodiment of this invention.
Figure 8:
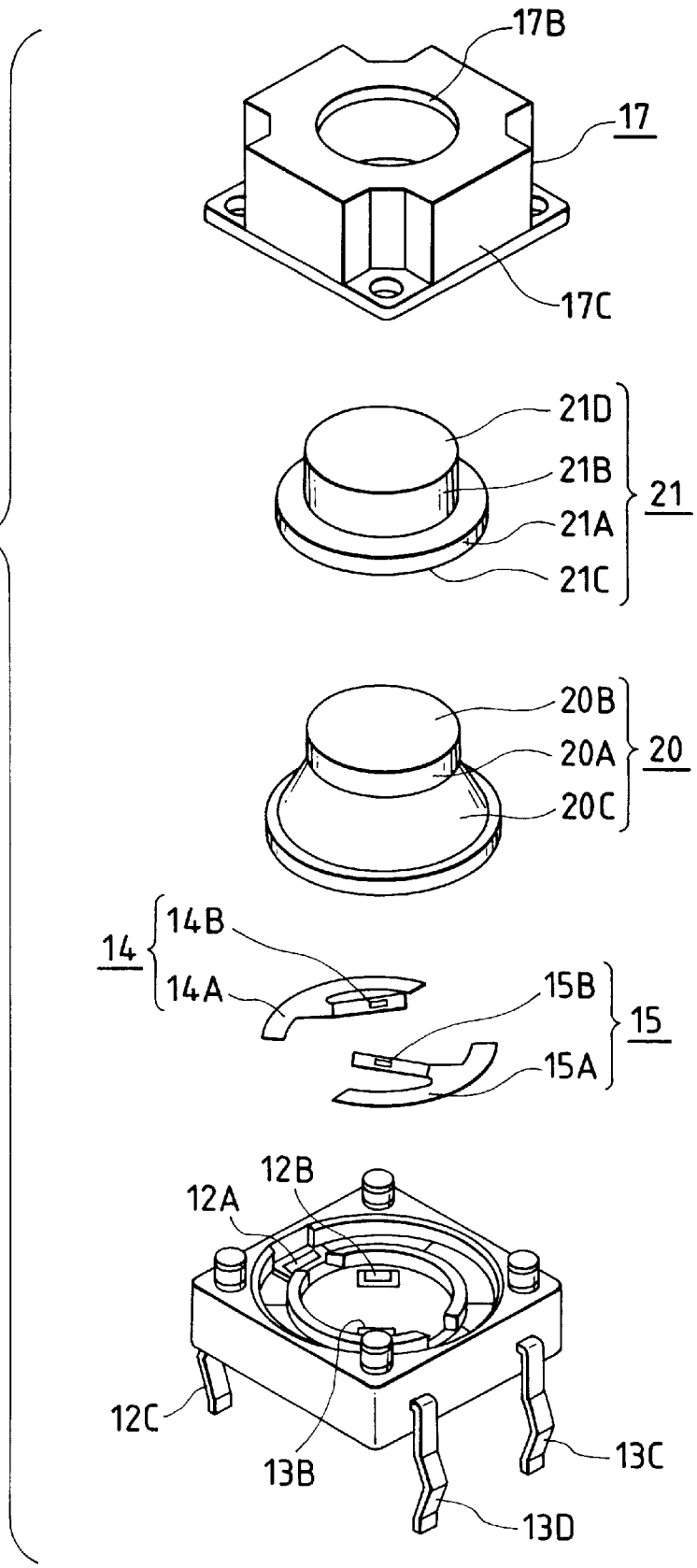
FIG. 8 is an exploded perspective view of the 2-circuit push-on switch in FIG. 7.

FIGS. 7 and 8 show a 2-circuit push-on switch according to a second embodiment of this invention. The 2-circuit push-on switch of FIGS. 7 and 8 is similar to the 2-circuit push-on switch of FIGS. 3–6 except for design changes indicated later. The 2-circuit push-on switch of FIGS. 7 and 8 includes a dome-shaped spring member 20 and a push button 21 instead of the dome-shaped spring member 16 (see FIGS. 3, 4, and 6).

As shown in FIG. 7, the whole of the dome-shaped spring member 20 is disposed in a switch interior space defined by a casing 11 and a lid member 17. The dome-shaped spring member is made of resilient insulating material. As shown in FIGS. 7 and 8, the dome-shaped spring member 20 has a central top portion 20A, and a dome portion 20C extending from the central top portion 20A. The central top portion 20A of the dome-shaped spring member 20 has an upper end surface 20B which is flat. The push button 21 is made of rigid material. The push button 21 is placed on the upper end surface 20B of the central top portion 20A of the dome-shaped spring member 20. The push button 21 has a cylindrical body 21B. The push button 21 has an annular flange 21A located at a lower end of the cylindrical body 21B. The annular flange 21A of the push button 21 is located in the switch interior space defined by the casing 11 and the lid member 17. The push button 21 has a lower end surface 21C which is flat. The lower end surface 21C of the push button 21 contacts with the upper end surface 20B of the central top portion 20A of the dome-shaped spring member 20. An upper part 21D of the cylindrical body 21B of the push button 21 forms an operating projection to be depressed.

The cylindrical body 21B of the push button 21 movably extends through a central circular opening 17B in an upper portion of the lid member 17. In the central circular opening 17B, there is a given small gap (a given clearance) between the lid member 17 and the cylindrical body 21B of the push button 21. Normally, the upper part 21D of the cylindrical body 21B of the push button 21, which forms the operating projection, extends outward of the central circular hole 17B in the lid member 17. Normally, the flange 21A of the push button 21 abuts against upper walls of the lid member 17. The flange 21A prevents the push button 21 from moving out of the lid member 17. The flange 21A is radially separate from inner circumferential surfaces of side walls of the lid member 17 by a given small gap (a given clearance).

Figure 9:
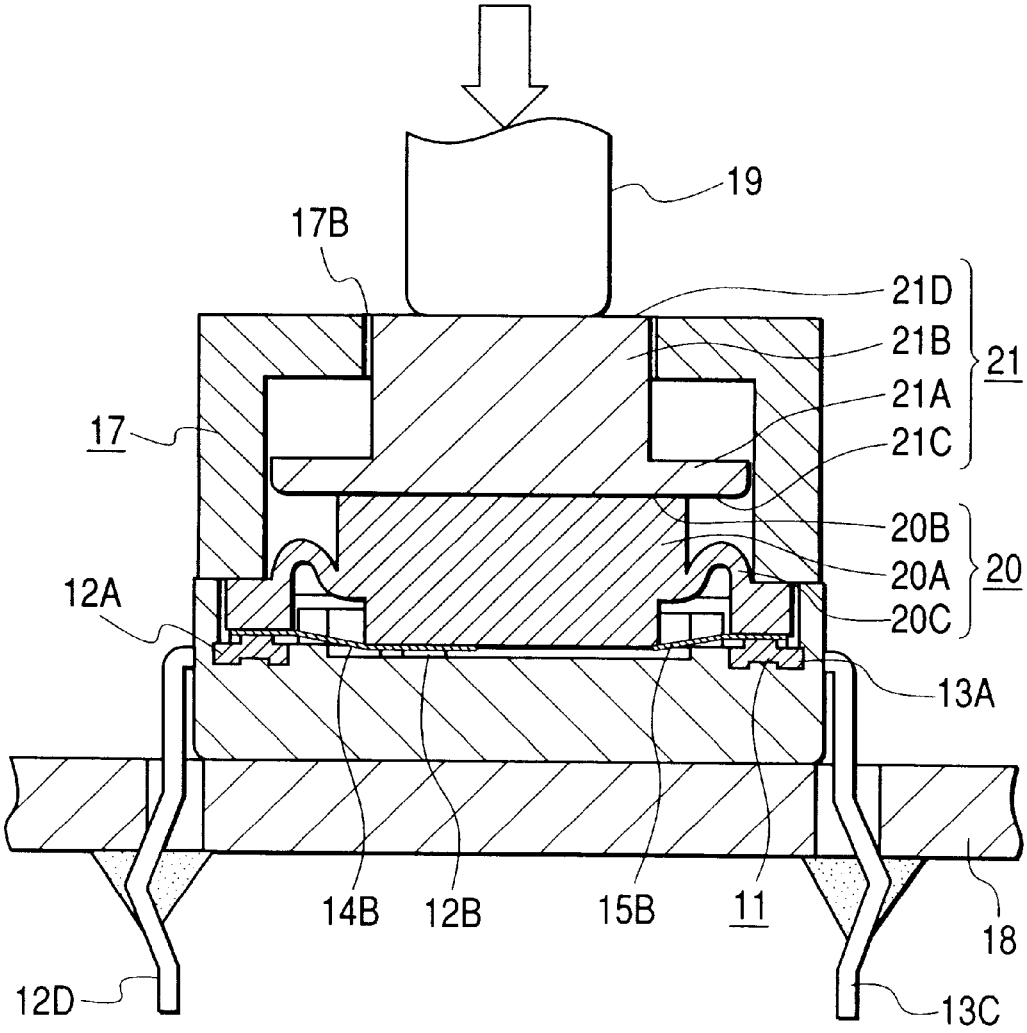
FIG. 9 is a sectional view of a portion of an electronic apparatus including the 2-circuit push-on switch in FIG. 7.

An explanation will be given of operation of the 2-circuit push-on switch of this embodiment. As shown in FIG. 9, the 2-circuit push-on switch is mounted on, for example, a printed circuit board 18 in an electronic apparatus. With reference to FIG. 7, when the 2-circuit push-on switch is in a normal state (an OFF state), the push button 21 and the central top portion 20A of the dome-shaped spring member 20 are in their uppermost positions. In this case, a lower end surface of the central top portion 20A is separate from resilient contact arms 14B and 15B, and also the resilient contact arms 14B and 15B are separate from inner fixed contacts 12B and 13B respectively.

As the push button 21 is depressed, the 2-circuit push-on switch changes from its normal state (its OFF state) to its ON state. Specifically, with reference to FIG. 9, as the push button 21 is depressed via an operation button 19 in the electronic apparatus, the central top portion 20A of the dome-shaped spring member 20 is moved downward together with the push button 21 while the dome portion 20C of the dome-shaped spring member 20 is resiliently deformed. The deformation of the dome portion 20C generates a reactional force which gives a suitable operation feeling to the user. During the depression of the push button 21, the lower end surface of the central top portion 20A of the dome-shaped spring member 20 meets the resilient contact arms 14B and 15B. Then, the central top portion 20A of the dome-shaped spring member 20 forces the resilient contact arms 14B and 15B downward, and brings them into contact with the inner fixed contacts 12B and 13B respectively. In this way, the 2-circuit push-on switch changes to its ON state where the resilient contact arms 14B and 15B are in electrical connection with the inner fixed contacts 12B and 13B respectively. In this case, the connection terminals 12C and 13C are in electrical connection with connection terminals 12D and 13D respectively. When the 2-circuit push-on switch assumes its ON state, the connection terminals 12C and 13C are electrically connected to the connection terminals 12D and 13D respectively at substantially the same time.

When the application of the depressing force to the push button 21 is removed, the dome portion 20C of the dome-shaped spring member 20 returns to its original shape. As the dome portion 20C of the dome-shaped spring member 20 returns to its original shape, the central top portion 20A of the dome-shaped spring member 20 and the push button 21 are moved upward. During the upward movement of the central top portion 20A of the dome-shaped spring member 20, the resilient contact arms 14B and 15B separate from the inner fixed contacts 12B and 13B respectively. Thus, the resilient contact arms 14B and 15B move out of electrical connection with the inner fixed contacts 12B and 13B respectively, and the connection terminals 12C and 13C are electrically disconnected from the connection terminals 12D and 13D respectively. Subsequently, the central top portion 20A of the dome-shaped spring member 20 separates from the resilient contact arms 14B and 15B, and then returns to its uppermost position. As the central top portion 20A of the dome-shaped spring member 20 returns to its uppermost position, the push button 21 also returns to its uppermost position. When the push button 21 reaches its uppermost position, the 2-circuit push-on switch returns to its normal state (its OFF state).

During the depression of the push button 21, the cylindrical body 21B of the push button 21 is guided along the central circular opening 17B in the lid member 17 while the flange 21A of the push button 21 is guided by the inner circumferential surfaces of the side walls of the lid member 17. Accordingly, the push button 21 is moved in a substantially or exactly vertical direction without being tilted. Thus, the central top portion 20A of the dome-shaped spring member 20 is also moved in a substantially or exactly vertical direction, enabling the resilient contact arms 14B and 15B to meet the inner fixed contacts 12B and 13B at more exactly the same time.

It should be noted that the 2-circuit push-on switch of this embodiment may be modified into a 3-circuit or more-circuit push-on switch.

Third Embodiment

Figure 10:
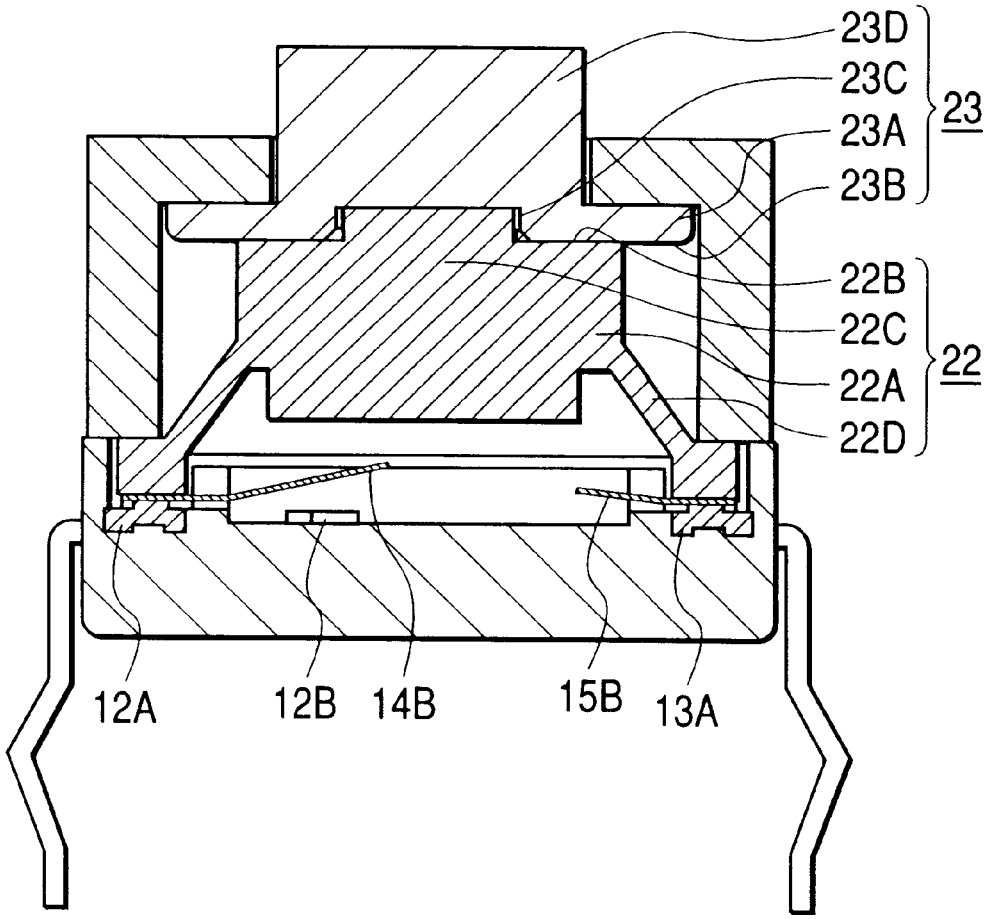
FIG. 10 is a sectional view of a 2-circuit push-on switch according to a third embodiment of this invention.

FIG. 10 shows a 2-circuit push-on switch according to a third embodiment of this invention. The 2-circuit push-on switch of FIG. 10 is similar to the 2-circuit push-on switch of FIGS. 7, 8, and 9 except for design changes indicated later. The 2-circuit push-on switch of FIG. 10 includes a dome-shaped spring member 22 and a push button 23 instead of the dome-shaped spring member 20 and the push button 21 (see FIGS. 7, 8, and 9).

As shown in FIG. 10, the dome-shaped spring member 22 has an upwardly-extending projection 22C of a circular cross-section. The projection 22C extends on a central area of an upper end surface 22B of a central top portion 22A of the dome-shaped spring member 22. A central area of a lower end surface 23B of the push button 23 has a circular recess 23C. The projection 22C of the dome-shaped spring member 22 fits into the recess 23C in the push button 23 so that the dome-shaped spring member 22 and the push button 23 are in engagement with each other. The push button 23 is made of rigid material.

During depression of the push button 23 to resiliently deform a dome portion 22D of the dome-shaped spring member 22, the engagement between the dome-shaped spring member 22 and the push button 23 via the projection 22C prevents a radial-direction positional shift (a positional error) from occurring between the upper end surface 22B of the dome-shaped spring member 22 and the lower end surface 23B of the push button 23. Thus, the central top portion 22A of the dome-shaped spring member 22 is moved accurately along a vertical direction in accordance with vertical depression of the push button 23, enabling resilient contact arms 14B and 15B to reliably meet inner fixed contacts 12B and 13B at more exactly the same time.

It should be noted that the 2-circuit push-on switch of this embodiment may be modified into a 3-circuit or more-circuit push-on switch.

Fourth Embodiment

Figure 11:
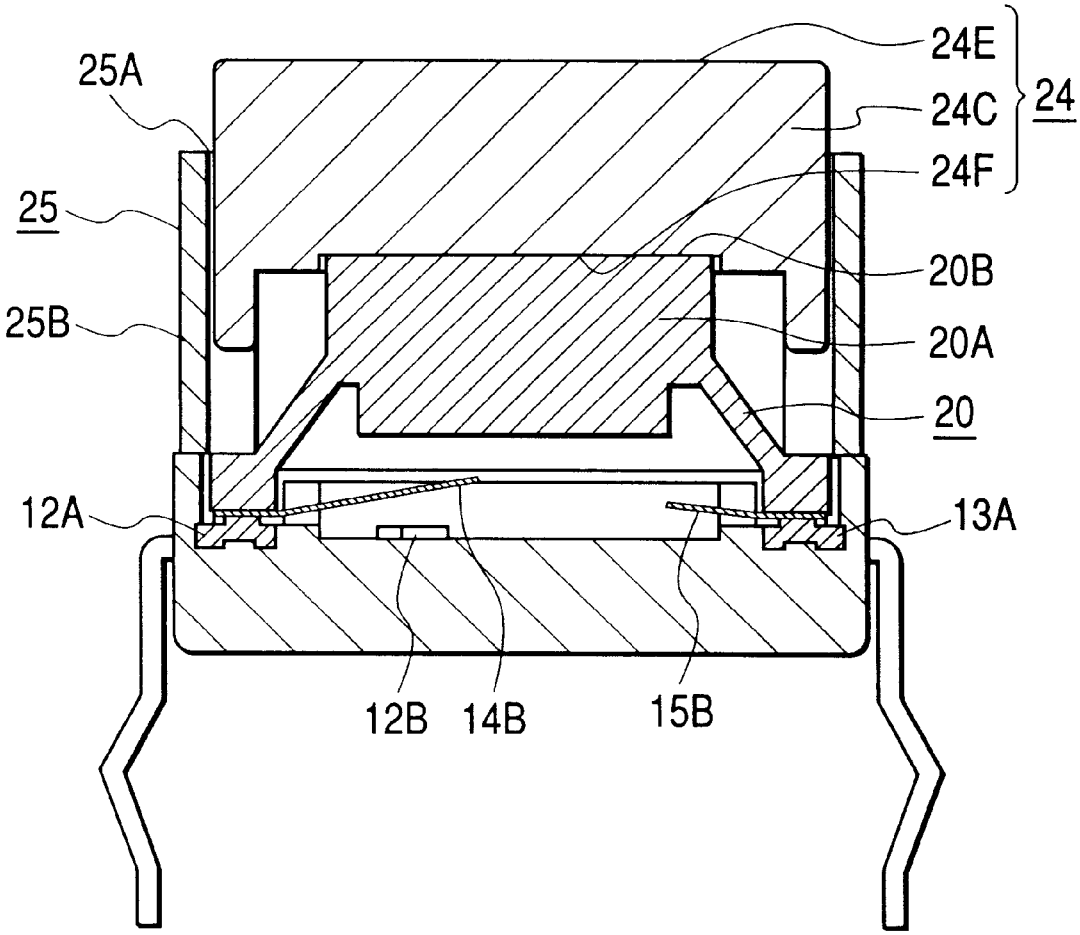
FIG. 11 is a sectional view of a 2-circuit push-on switch according to a fourth embodiment of this invention.
Figure 12:
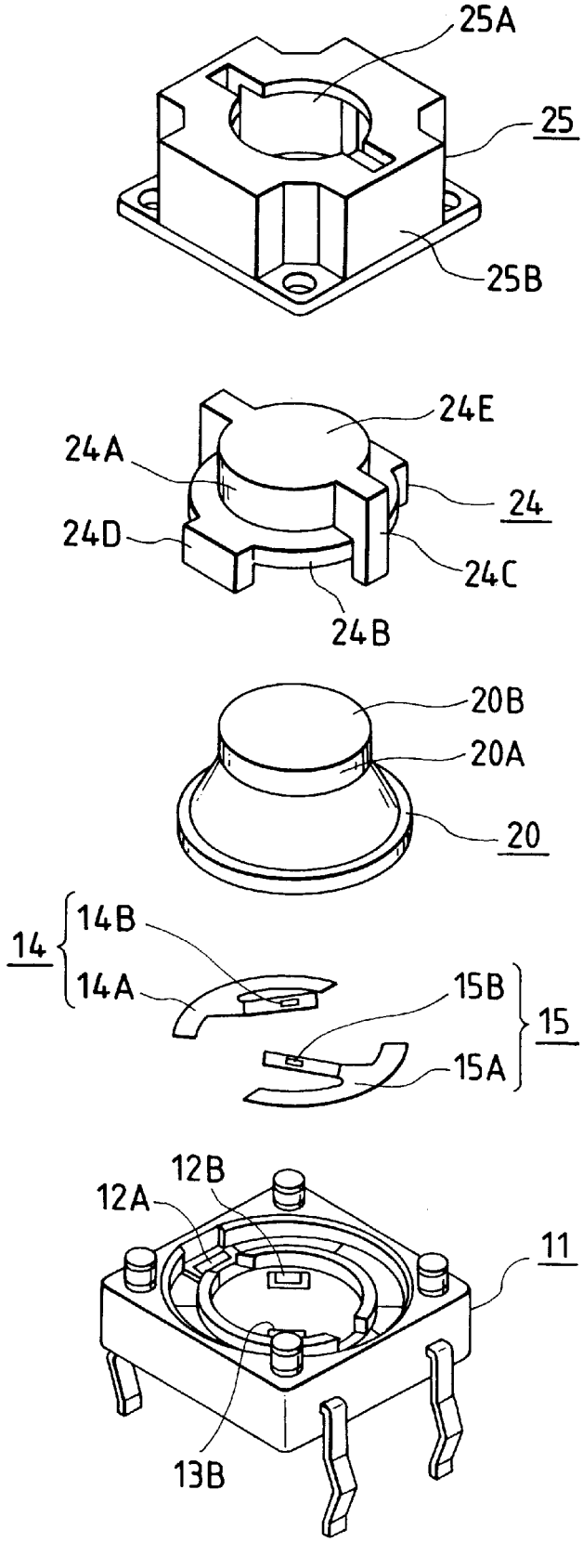
FIG. 12 is an exploded perspective view of the 2-circuit push-on switch in FIG. 11.

FIGS. 11 and 12 show a 2-circuit push-on switch according to a fourth embodiment of this invention. The 2-circuit push-on switch of FIGS. 11 and 12 is similar to the 2-circuit push-on switch of FIGS. 7, 8, and 9 except for design changes indicated later. The 2-circuit push-on switch of FIGS. 11 and 12 includes a push button 24 and a lid member 25 instead of the push button 21 and the lid member 17 (see FIGS. 7, 8, and 9).

As shown in FIGS. 11 and 12, the push button 24 has an approximately cylindrical shape. Specifically, the push button 24 has a cylindrical body 24A, and a pair of projections 24C extending radially outward from the cylindrical body 24A. The projections 24C are diametrically opposed to each other. The projections 24C also extend axially with respect to the cylindrical body 24A. The push button 24 has an annular flange 24B formed on a lower end of the cylindrical body 24A. In addition, the push button 24 has a pair of projections 24D extending radially outward from the annular flange 24B. The projections 24D are diametrically opposed to each other. The projections 24D are angularly spaced from the projections 24C by intervals of 90°. The projections 24D also extend axially with respect to the annular flange 24B. The push button 24 is made of rigid material.

An upper portion of the lid member 25 has a non-circular central hole 25A. The non-circular central hole 25A has a circular portion, and a pair of groove portions extending radially outward from the circular portion. The groove portions are diametrically opposed to each other. The groove portions also extend axially. The cylindrical body 24A of the push button 24 movably extends through the circular portion of the non-circular central hole 25A in the lid member 25. The projections 24C of the push button 24 movably fits into the groove portions of the non-circular central hole 25A in the lid member 25, respectively. Thus, the projections 24C of the push button 24 engage the lid member 25. This engagement provides a key coupling between the push button 24 and the lid member 25 which allows axial movement (vertical movement) of the push button 24 relative to the lid member 25 while inhibiting circumferential rotation of the push button 24 relative to the lid member 25.

Figure 13:
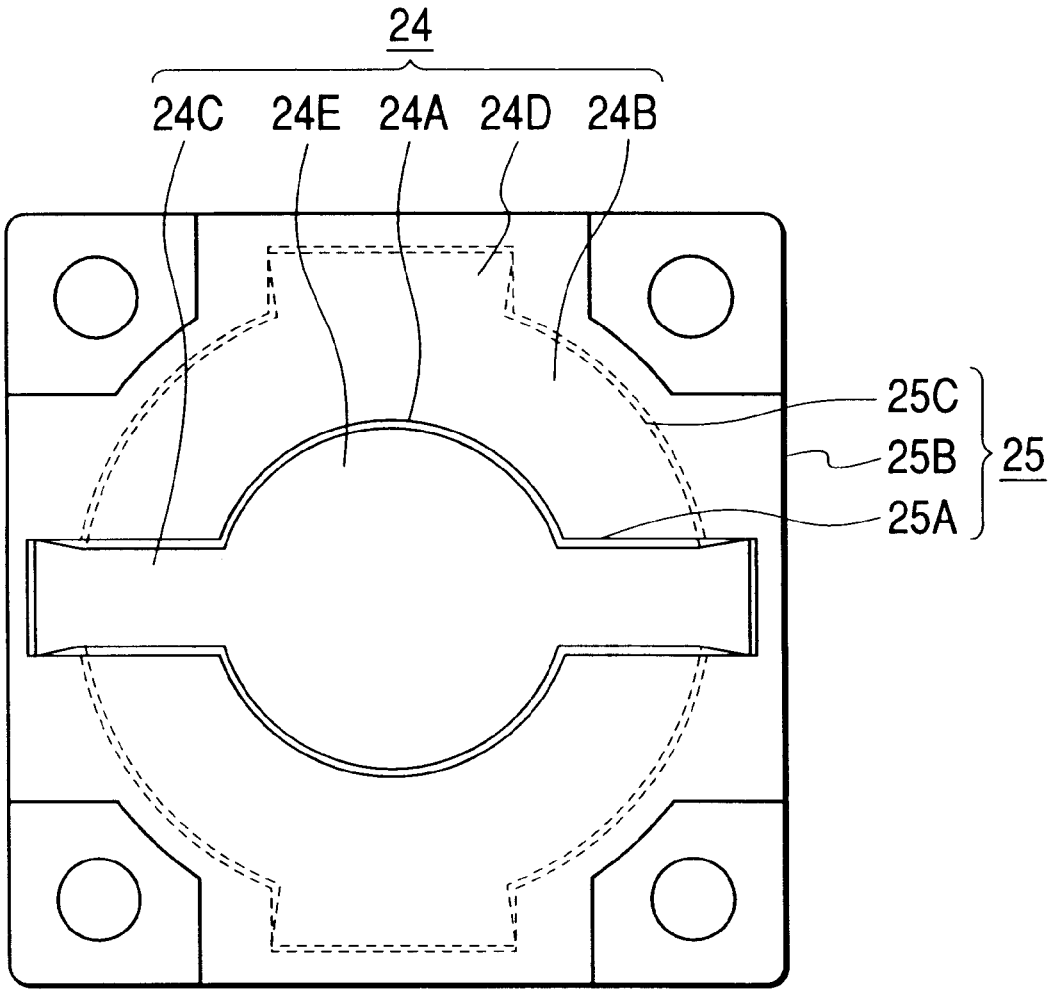
FIG. 13 is a top view of the 2-circuit push-on switch in FIG. 11.

As shown in FIG. 13, outer side walls 25B of the lid member 25 have a non-circular hole or recess 25C. The non-circular hole 25C has a circular portion, and four groove portions extending radially outward from the circular portion. The groove portions are angularly spaced by intervals of 90°. The annular flange 24B of the push button 24 movably fits in the circular portion of the non-circular hole 25C in the lid member 25. The projections 24C and the projections 24D of the push button 24 movably fit in the groove portions of the non-circular hole 25C in the lid member 25, respectively. Thus, the projections 24C and the projections 24D of the push button 24 engage the lid member 25. This engagement provides a key coupling between the push button 24 and the lid member 25 which allows axial movement (vertical movement) of the push button 24 relative to the lid member 25 while inhibiting circumferential rotation of the push button 24 relative to the lid member 25.

During depression of the push button 24, the cylindrical body 24A and the projections 24C of the push button 24 are guided vertically along the non-circular central hole 25A in the upper portion of the lid member 25 while being inhibited from circumferentially rotating. At the same time, the annular flange 24B, the projections 24C, and the projections 24D of the push button 24 are guided vertically along the non-circular hole 25C in the outer side walls 25B of the lid member 25 while being inhibited from circumferentially rotating. Accordingly, the push button 24 is moved in a substantially or exactly vertical direction without being tilted. Thus, a central top portion 20A of a dome-shaped spring member 20 is also moved in a substantially or exactly vertical direction, enabling resilient contact arms 14B and 15B to meet inner fixed contacts 12B and 13B at more exactly the same time.

As shown in FIG. 11, a lower end surface of the push button 24 has a circular recess 24F into which the central top portion 20A of the dome-shaped spring member 20 fits. This design enables stable vertical movement of the central top portion 20A of the dome-shaped spring member 20 during the depression of the push button 24.

It should be noted that the 2-circuit push-on switch of this embodiment may be modified into a 3-circuit or more-circuit push-on switch.

Fifth Embodiment

Figure 14:
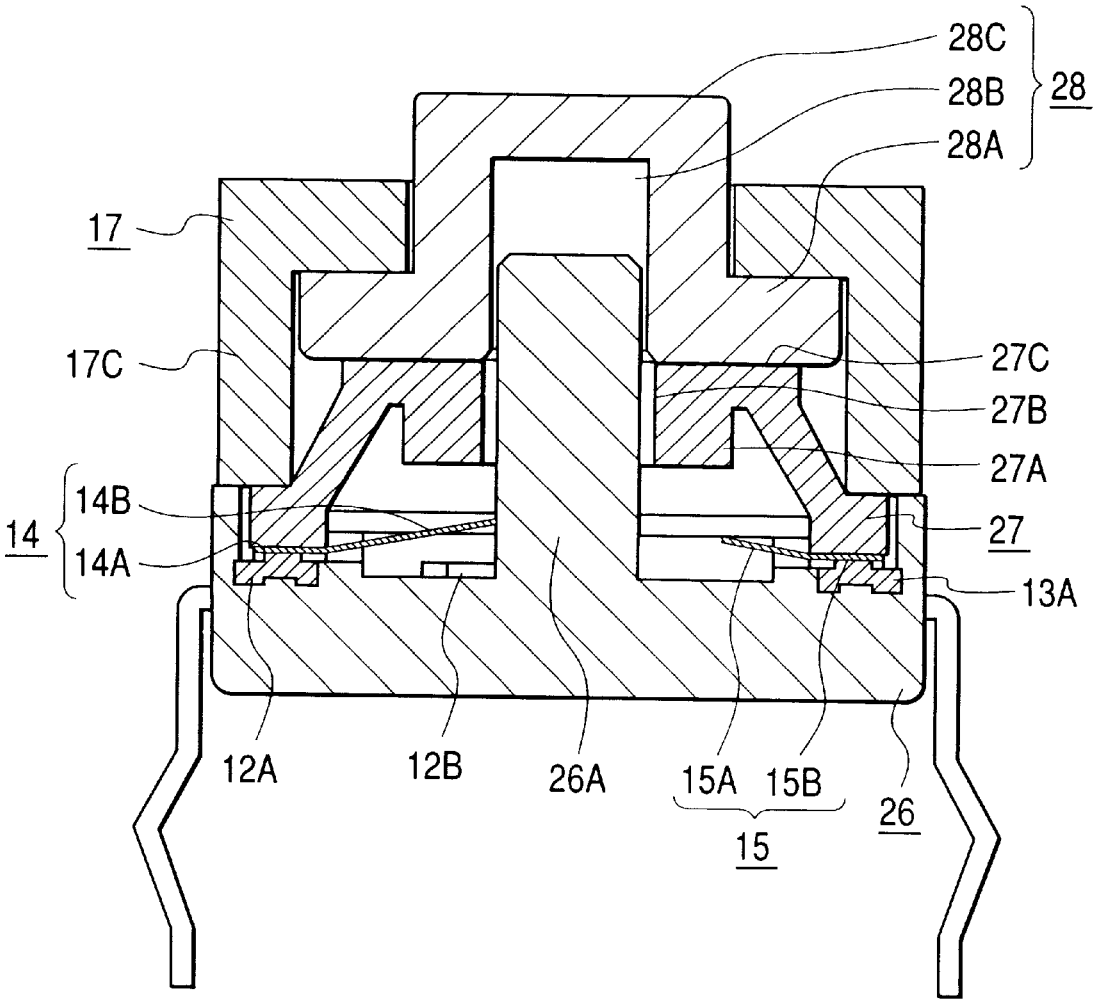
FIG. 14 is a sectional view of a 2-circuit push-on switch according to a fifth embodiment of this invention.

FIG. 14 shows a 2-circuit push-on switch according to a fifth embodiment of this invention. The 2-circuit push-on switch of FIG. 14 is similar to the 2-circuit push-on switch of FIGS. 7, 8, and 9 except for design changes indicated later. The 2-circuit push-on switch of FIG. 14 includes a casing 26, a dome-shaped spring member 27, and a push button 28 instead of the casing 11, the dome-shaped spring member 20, and the push button 21 (see FIGS. 7, 8, and 9).

As shown in FIG. 14, a stem or a shaft 26A having a circular cross-section projects upward from a central area of bottom walls of the casing 26. A central top portion 27A of the dome-shaped spring member 27 has a center hole 27B through which the stem 26A extends. The central hole 27B has a circular cross-section. In the center hole 27B, there is a given small gap (a given clearance) between the stem 26A and the central top portion 27A of the dome-shaped spring member 27. The push button 28 is made of rigid material. The push button 28 has an annular flange 28A at its lower end. The push button 28 has a lower end surface formed with a central groove 28B of a circular cross-section. The stem 26A extends into the central groove 28B in the push button 28. In the central groove 28B, there is a given small gap (a given clearance) between the stem 26A and the push button 28. Normally, an upper portion 28C of the push button 28 is located outward of a central circular hole in upper walls of a lid member 17.

The annular flange 28A of the push button 28 slidably fits in a circular opening which is defined by outer side walls 17C of the lid member 17. There is a given small gap (a given clearance) between the annular flange 28A and the outer side walls 17C of the lid member 17. The push button 28 is movably placed around the stem 26A. Accordingly, the push button 28 is supported by the outer side walls 17C of the lid member 17 and also the stem 26A.

During depression of the push button 28, the push button 28 is guided vertically along the outer side walls 17C of the lid member 17 and the stem 16A. Accordingly, the push button 28 is moved in a substantially or exactly vertical direction without being tilted. Thus, a central top portion 27A of the dome-shaped spring member 27 is also moved in a substantially or exactly vertical direction. During the vertical movement, the central top portion 27A of the dome-shaped member 27 is guided along the step 26A. Therefore, the central top portion 27A of the dome-shaped spring member 27 is prevented from shifting in a direction perpendicular to the vertical direction. Thus, the central top portion 27A of the dome-shaped spring member 27 enables resilient contact arms 14B and 15B to meet inner fixed contacts 12B and 13B at more exactly the same time.

During assembly of the 2-circuit push-on switch of this embodiment, base portions 14A and 15A of movable contacts 14 and 15 are placed on outer fixed contacts 12A and 13A extending on upper surfaces of the bottom walls of the casing 26. Then, the dome-shaped spring member 27 and the push button 28 are placed around the step 26A while the step 26A is used as a guide. Subsequently, the lid member 17 is placed so as to cover portions of the dome-shaped spring member 27 and the button 28. Generally, the assembly of the 2-circuit push-on switch is efficient. In addition, the assembly of the 2-circuit push-on switch can be implemented on an automatic basis.

It should be noted that the 2-circuit push-on switch of this embodiment may be modified into a 3-circuit or more-circuit push-on switch.

Sixth Embodiment

A 2-circuit push-on switch of a sixth embodiment of this invention is similar to the 2-circuit push-on switch of one of the first, second, third, fourth, and fifth embodiments of this invention except for design changes indicated below.

Figure 15:
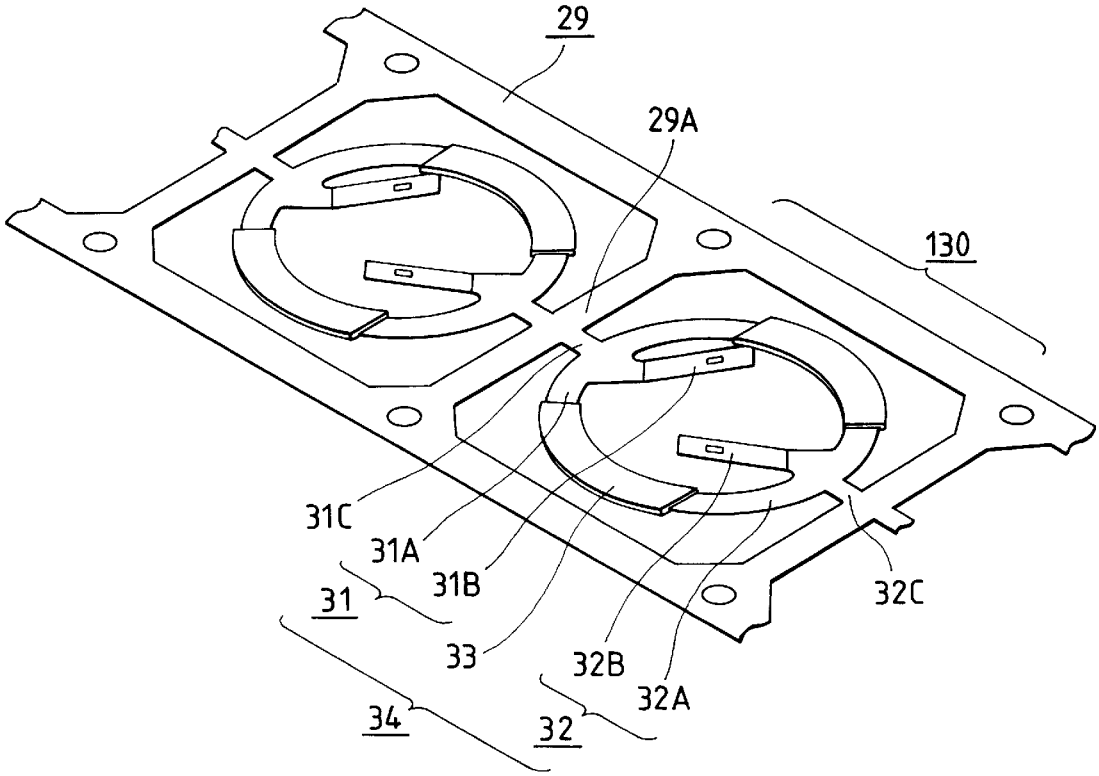
FIG. 15 is a perspective view of a movable contact hoop used during the manufacture of a 2-circuit push-on switch according to a sixth embodiment of this invention.

With reference to FIG. 15, a movable contact hoop 29 results from punching and bending a resilient metal thin plate having a belt-like shape. The punching and the bending are implemented by a pressing machine. The movable contact hoop 29 has a sequence of movable contact blocks 30 each corresponding to a pair of movable contacts 31 and 32. Each of the movable contact blocks 30 has base portions 31A and 32A. The base portions 31A and 32A are connected to bridges 29A by connection portions 31C and 32C in a manner such that two movable contacts 31 and 32 will be in a positional relation equal to a positional relation occurring in a completed 2-circuit push-on switch. Ends of the base portions 31A and 32A are connected by arcuate flat plates 33 of insulating resin by an outsert molding process in a manner such that lower surfaces of the base portions 31A and 32A remain exposed. Then, the connection portions 31C and 32C are removed from each movable contact block 30 by a cutting process so that the movable contact block 30 is made into a movable contact member 34 shown in FIG. 16. The movable contact member 34 has a loop shape.

Figure 16:
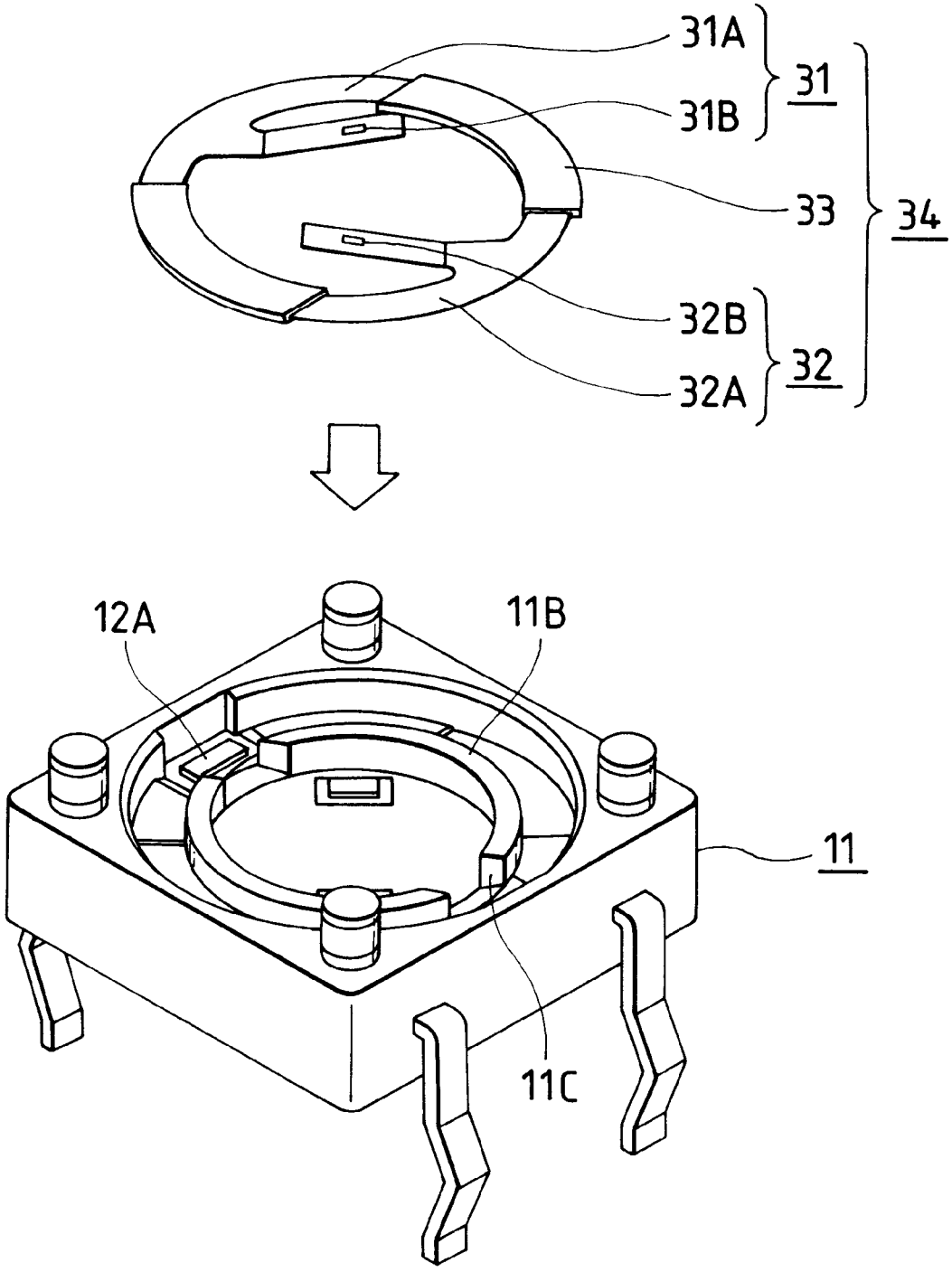
FIG. 16 is a perspective view of a movable contact member and a casing in first conditions during the manufacture of the 2-circuit push-on switch according to the sixth embodiment of this invention.
Figure 17:
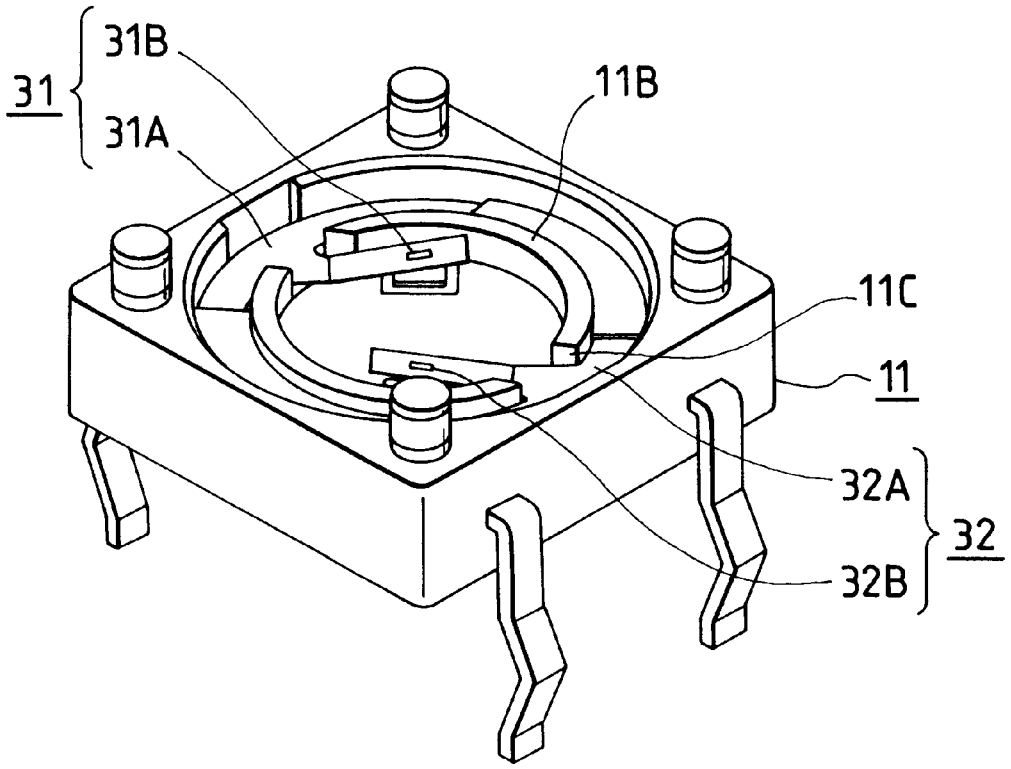
FIG. 17 is a perspective view of the movable contact member and the casing in second conditions during the manufacture of the 2-circuit push-on switch according to the sixth embodiment of this invention.

With reference to FIGS. 16 and 17, during assembly of a 2-circuit push-on switch, the movable contact member 34 is placed on a casing 11 in such a manner as to provide the following conditions. The base portions 31A and 32A of the movable contacts 31 and 32 extend over outer fixed contacts 12A and 13A formed on upper surfaces of bottom walls of the casing 11. Resilient contact arms 31B and 32B extend through grooves 11C in an annular projection 11B on the bottom walls of the casing 11. Accordingly, the movable contacts 31 and 32 are placed in predetermined positions with respect to the casing 11. Thereafter, the movable contacts 31 and 32 stably remain in the predetermined positions.

After the movable contact member 34 is placed on the casing 11, a dome-shaped spring member 20 is placed on the movable contact member 34. Then, a lid member 17 is placed so as to close an upper end of a recess in the casing 11.

As understood from the above explanation, the movable contacts 31 and 32 are easily and surely located at the predetermined positions with respect to the casing 11. Thereafter the movable contacts 31 and 32 stably remain in the predetermined positions. Accordingly, the 2-circuit push-on switch of this embodiment is suited to automatic assembly.

It should be noted that the 2-circuit push-on switch of this embodiment may be modified into a 3-circuit or more-circuit push-on switch.

What is claimed is:

1. A push-on switch comprising:

a casing made of insulating material and having an inner bottom surface;

first fixed contacts provided on the inner bottom surface of the casing;

second fixed contacts provided on the inner bottom surface of the casing;

movable contacts having base portions and resilient contact arms, the base portions being placed on and electrically connected to the first fixed contacts respectively, the resilient contact arms extending from the base portions to regions above the second fixed contacts respectively;

a dome-shaped spring member made of resilient insulating material and having a top portion, a conical portion, and a lower end, the top portion and the lower end being connected by the conical portion, the lower end being placed on the base portions of the movable contacts, the top portion having a lower surface located above free ends of the resilient contact arms of the movable contacts; and a lid member fixed to the casing and having a hole through which the top portion of the dome-shaped spring member extends, the lid member pressing the lower end of the dome-shaped spring member against the base portions of the movable contacts;

wherein as the top portion of the dome-shaped spring member is depressed, the dome-shaped spring member brings the resilient contact arms into contact with the second fixed contacts respectively.

2. A push-on switch as recited in claim 1, wherein the casing has a projection at the inner bottom surface thereof, the projection extending along a circle, the base portions of the movable contacts being located between the projection and an outer side wall of the casing, the projection having grooves through which the resilient contact arms of the movable contacts extend, the lower end of the dome-shaped spring member being located between the projection and the outer side wall of the casing.

3. A push-on switch as recited in claim 1, wherein the base portions of the movable contacts are connected by insulating members while lower surfaces of the base portions of the movable contacts are uncovered from the insulating members.

4. A push-on switch comprising:

a casing made of insulating material and having an inner bottom surface;

first fixed contacts provided on the inner bottom surface of the casing;

second fixed contacts provided on the inner bottom surface of the casing;

movable contacts having base portions and resilient contact arms, the base portions being placed on and electrically connected to the first fixed contacts respectively, the resilient contact arms extending from the base portions to regions above the second fixed contacts respectively;

a dome-shaped spring member made of resilient insulating material and having a top portion, a conical portion, and a lower end, the top portion and the lower end being connected by the conical portion, the lower end being placed on the base portions of the movable contacts, the top portion having a lower surface located above free ends of the resilient contact arms of the movable contacts;

a push button made of rigid material and placed on the top portion of the dome-shaped spring member; and a lid member fixed to the casing and having a hole through which the push button extends, the lid member pressing the lower end of the dome-shaped spring member against the base portions of the movable contacts, the lid member supporting the push button;

wherein as the push button is depressed, the dome-shaped spring member is moved by the push button and brings the resilient contact arms into contact with the second fixed contacts respectively.

5. A push-on switch as recited in claim 4, wherein the push button has a recess, and the top portion of the dome-shaped spring member has a projection fitting into the recess of the push button to provide an engagement between the push button and the top portion of the dome-shaped spring member.

6. A push-on switch as recited in claim 4, further comprising a key coupling provided between the push button and the lid member for allowing depression of the push button relative to the lid member while inhibiting the push button from circumferentially rotating relative to the lid member.

7. A push-on switch as recited in claim 5, further comprising a key coupling provided between the push button and the lid member for allowing depression of the push button relative to the lid member while inhibiting the push button from circumferentially rotating relative to the lid member.

8. A push-on switch as recited in claim 4, wherein the casing has a stem extending upward from the inner bottom surface thereof, and the top portion of the dome-shaped spring member has a hole through which the stem extends, and the push button has a recess into which the stem extends.

9. A push-on switch as recited in claim 4, wherein the base portions of the movable contacts are connected by insulating members while lower surfaces of the base portions of the movable contacts are uncovered from the insulating members.

10. A push-on switch as recited in claim 4, wherein the casing has a projection at the inner bottom surface thereof, the projection extending along a circle, the base portions of the movable contacts being located between the projection and an outer side wall of the casing, the projection having grooves through which the resilient contact arms of the movable contacts extend, the lower end of the dome-shaped spring member being located between the projection and the outer side wall of the casing.

* * * * *